United States Patent [19]

Wallin

[11] Patent Number: 4,612,013

[45] Date of Patent: Sep. 16, 1986

[54] PROCESS FOR THE TREATMENT OF CELLULOSE ACETATE FIBER

[76] Inventor: Guy R. Wallin, 1026 Barbee St., High Point, N.C. 27260

[21] Appl. No.: 723,529

[22] Filed: Apr. 15, 1985

[51] Int. Cl.[4] ..... D06M 13/34

[52] U.S. Cl. ..... 8/196; 8/129; 8/115.66

[58] Field of Search ..... 8/115.66, 196, 129

[56] References Cited

U.S. PATENT DOCUMENTS

| | | | |
|---|---|---|---|
| 1,833,286 | 11/1931 | Hagedorn | 8/129 |
| 2,241,542 | 5/1941 | Dreyfus | 260/212 |
| 2,793,930 | 5/1957 | Compton et al. | 8/129 |
| 3,388,118 | 6/1968 | Giuliana | 260/212 |
| 3,880,582 | 4/1975 | Sawaya | 8/115.66 |
| 4,103,051 | 7/1978 | Farmer | 427/394 |

OTHER PUBLICATIONS

Moncrieff, R. W., Man-Made Fibers, 1970 (Chapter 11), pp. 221-226.

*Primary Examiner*—Paul Lieberman
*Assistant Examiner*—Brooks Alan Truskett
*Attorney, Agent, or Firm*—Norman B. Rainer

[57] ABSTRACT

Cellulose acetate fibers are treated with hot aqueous or ethanolic solutions of o-phenylenediamine, triethylene tetramine or toluene diamine to improve the wrinkle resistance of fabrics, increase moisture regain, reduce static accumulation, and increase affinity for acid dyes.

8 Claims, No Drawings

PROCESS FOR THE TREATMENT OF CELLULOSE ACETATE FIBER

BACKGROUND OF THE INVENTION

This invention relates to a method for improving certain properties of fibrous forms of cellulose acetate by way of a chemical aftertreatment.

Various fibrous forms of cellulose acetate are in widespread current use in diverse products. Woven or knitted fabrics comprised of fine denier continuous filament cellulose acetate find extensive application for lingerie, sleepwear, interlinings and blouses. Heavier deniers of continuous filament cellulose acetate are utilized in crimped and uncrimped form in drapery, curtian and upholstery fabrics. Spun yarns comprised entirely or in part of staple length cellulose acetate fiber are utilized in various apparel fabrics where a high loft or soft texture is sought. In non-fabric applications, cellulose acetate fibers find extensive use in the production of cigarette fibers and battings used for cushioning or insulative purposes.

Two distinct types of cellulose acetate fiber are recognized, namely secondary acetate and triacetate, both being produced by the acetylation of cellulose with acetic anhydride. Secondary cellulose acetate, which is soluble in acetone, has an average degree of acetylation of between about 1.8 and 2.3 acetyl groups per anhydroglucose unit of the cellulose molecule. Solutions of the secondary acetate in acetone are utilized for the production of fibers by a dry spinning technique wherein the solution is extruded through a spinnerette downwardly through an elongated evaporative chamber.

Cellulose triacetate has an average degree of acetylation between about 2.3 and 2.9, and is generally dry spun into filaments from methylene chloride/alcohol solutions. It is a hydrophobic fiber, having a normal moisture content of about 2%. In comparison to secondary acetate fibers, triacetate fibers are less sensitive to hot water and provider greater wrinkle resistance in fabrics. Despite the several property improvements produced by the higher degree of acetylation of the triacetate, further improvements in the characteristics of acetate fibers have long been sought. In fabrics, sought improvements have been in the areas of wrinkle resistance, permanent press capability, increased moisture regain, freedom from static build-up, and soil release.

It is accordingly an object of the present invention to provide a treatment of cellulose acetate fiber which will improve the characteristics of fabrics comprised of said fiber.

It is another object of this invention to treat fabrics comprised of cellulose acetate fiber to improve the characteristics of said fabrics.

It is a further object to the present invention to provide a treatment of the aforesaid nature which is economical and easily controllable.

These objects and other objects and advantages of the invention will be apparent from the following description.

SUMMARY OF THE INVENTION

The above and other beneficial objects and advantages are accomplished in accordance with the present invention by immersing cellulose acetate fibrous material in an aqueous or ethanolic solution containing between about 5% and 15% of an organic amine selected from the group consisting of o-phenylenediamine, triethylene tetramine and toluene diamine, said solution being maintained at a temperature in the range of about 70° C. and 130° C., the duration of said immersion ranging between about 30 minutes and 12 hours, and washing and drying the fibrous material.

The fibrous material is preferably in the form of fabric, or yarn in skein or bobbin packaging. When the solution is ethanolic, the treatment is preferably carried out in a sealed vessel equipped with a reflux condenser, whereby the solution can be boiled and thereby maintained at constant temperature. In the case of aqueous solutions a similar vessel may be used or a pressurized vessel may be used, thereby permitting securement of temperatures above 100° C.

Since o-phenylenediamine and toluene diamine are not soluble in water, these aromatic organic amines are utilized in ethanolic solution. In such cases, the solution is made more basic by the addition of 1% to 3% of an aliphatic amine of low volatility such as ethylene diamine, diethanol amine and triethanol amine. Said aliphatic amines will have a boiling point generally above 100° C.

The triethylene tetramine can be utilized in either ethanol or water solutions, and is sufficiently basic so that the further addition of another aliphatic amine is not necessary.

DESCRIPTION OF THE PREFERRED EMBODIMENTS

The present invention is based in part upon the discovery that the critically selected organic amines referred to hereinabove, under critically selected reaction conditions, replace acetate groups and combine with the cellulose acetate in a cross-linking type of reaction. The consequences of such events is to cause the treated fibers to be more hydrophilic, substantive to acid dyes, and wrinkle-resistant.

The following examples illustrate preferred embodiments of the present invention but are not intended to restrict the scope thereof. In the examples, parts and percentages are by weight unless otherwise noted.

EXAMPLE 1

Twenty two grams of a woven sharkskin fabric of continuous filament cellulose triacetate of 3 denier per filament was placed in a distilling flask with a solution comprising 20 grams o-phenylene diamine, 2 grams ethylene diamine, and 200 ml ethyl acholol.

The mixture was heated at a refluxing temperature of 78° C. for 12 hours. The fabric was then removed, washed with water and dried.

The fabric was found to contain NH or $NH_2$ groups by the NaOCl-Phenol test. The fabric showed very good wash and wear properties after three launderings, each utilizing a 30 minute wash cycle and 30 minute drying cycle. There was good crease retention in comparison to untreated fabric similarly laundered. The fabric had a slight tan color, but this color was found to be removable by immersion of the fabric in an aqueous soluton containing 2% Textone and 2% acetic acid and maintained at 80°-90° C.

The treated fabric further demonstrated the following characteristics:

(1) moisture regain of 14.6% at 60–70% relative humidity (2) soluble in glacial acetic acid (3) soluble in ethylene dichloride
(4) slightly soluble in acetone
(5) accepts acid dye.

The fabric no longer had a propensity to develop a static charge. Such transformation is attributable to the high moisture content of the treated fabric. Greater wear comfort is also provided because of the fabric's ability to transpire perspiration.

EXAMPLE 2

A twenty gram piece of plain weave fabric of continuous filament cellulose triacetate of 3 denier per filament was placed in a autoclave with a solution comprising 180 grams water and 20 grams triethylene tetramine. The autoclave was heated so as to generate a pressure of 15 lbs. for a period of 30 minutes. The fabric was then removed, washed with water and dried.

In wash and wear cycle testing, employing the laundering cycle of Example 1, the treated fabric was found to have improved characteristics. After six launderings, a heat set crease was still retained. By way of comparison, the untreated starting fabric could not retain a heat set crease after 2 launderings.

The treated fabric further demonstrated the following characteristics:

(1) moisture regain of 7% at 60–70 relative humidity
(2) partially soluble in glacial acetic acid
(3) slightly soluble in acetone
(4) partly soluble in ethylene dichloride
(5) positive NaOCl-Phenol test for NH and $NH_2$ groups
(6) accepts an acid dye such as Tartrazine.

EXAMPLE 3

A 20 gram piece of a woven suiting fabric made from spun staple triacetate fiber of 3.5 denier per filament was placed in a flask containing a solution comprised of 20 grams 2,4-toluene diamine, 4 grams ethylene diamine and 180 grams ethanol. The mixture was heated at 80° C. under reflux conditions for 12 hours. The fabric was then removed, washed with water and dried.

A heat set crease was formed in the treated fabric and the fabric was put through wash and wear cycle testing. It was found that the crease was retained after six cycles.

The treated fabric of this example further demonstrated the following characteristics:

(1) moisture regain of 13.2% at 60–70% relative humidity
(2) soluble in glacial acetic acid
(3) slightly soluble in acetone
(4) soluble in ethylene dichloride
(5) soluble in phenol
(6) soluble in formic acid
(7) presence of NH and $NH_2$ groups confirmed by NaOCl-Phenol test.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A process for the crosslinking treatment of cellulose acetate fibrous material to improve the wrinkle-resistance thereof comprising:

(a) immersing said fibrous material in an aqueous or ethanolic solution containing between about 5% and 15% of an organic amine selected from the group consisting of o-phenylenediamine, triethylene tetramine and toluene diamine, said solution being maintained at a temperature in the range of about 70 degrees C. to 130 degrees C., and the duration of said immersion ranging between about 30 minutes and 12 hours,
(b) removing said fibrous material from said solution, and
(c) washing and drying said fibrous material.

2. The process of claim 1 wherein said fibrous material is in fabric form.

3. The process of claim 1 wherein an ethanolic solution is employed, and constant temperature is maintained by refluxing said solution.

4. The process of claim 1 wherein an aqueous solution is utilized and maintained within a heated, pressurized vessel, whereby temperatures above 100° C. may be secured.

5. The process of claim 1 wherein said organic amine is o-phenylenediamine or toluene diamine, and said solution is ethanolic.

6. The process of claim 5 wherein said solution further contains between 1% and 3% by weight of an aliphatic amine of low volatility.

7. The process of claim 1 wherein said toluene diamine is 2, 4 toluene diamine.

8. The process of claim 6 wherein said aliphatic amine is ethylene diamine.

* * * * *